US009066592B2

(12) United States Patent
Kinczkowski

(10) Patent No.: US 9,066,592 B2
(45) Date of Patent: Jun. 30, 2015

(54) PORTABLE CHAIR

(71) Applicant: Thomas J. Kinczkowski, Brighton, MI (US)

(72) Inventor: Thomas J. Kinczkowski, Brighton, MI (US)

( * ) Notice: Subject to any disclaimer, the term of this patent is extended or adjusted under 35 U.S.C. 154(b) by 111 days.

(21) Appl. No.: 13/968,477

(22) Filed: Aug. 16, 2013

(65) Prior Publication Data

US 2014/0049087 A1 Feb. 20, 2014

Related U.S. Application Data

(60) Provisional application No. 61/684,295, filed on Aug. 17, 2012.

(51) Int. Cl.
*A47C 1/00* (2006.01)
*A47C 9/10* (2006.01)

(52) U.S. Cl.
CPC .... *A47C 1/00* (2013.01); *A47C 9/10* (2013.01)

(58) Field of Classification Search
CPC ..... A47C 9/10
USPC ..... 297/4, 16.1, 16.2, 17, 440.15
See application file for complete search history.

(56) References Cited

U.S. PATENT DOCUMENTS

| | | | | | |
|---|---|---|---|---|---|
| 1,972,668 | A | * | 9/1934 | Sheldon | 248/155.2 |
| 3,266,839 | A | * | 8/1966 | Combs | 297/57 |
| 3,283,733 | A | * | 11/1966 | Boerma | 108/159 |
| 4,085,686 | A | * | 4/1978 | Turner et al. | 108/25 |
| 4,130,294 | A | * | 12/1978 | Walker | 280/812 |
| 5,188,422 | A | | 2/1993 | Montgomery | |
| 5,673,966 | A | | 10/1997 | Morton, Jr. | |
| 5,975,635 | A | * | 11/1999 | Parpala | 297/338 |
| 6,033,016 | A | | 3/2000 | Haywood | |
| 6,035,572 | A | * | 3/2000 | Goode, Jr. | 42/94 |
| 6,176,545 | B1 | * | 1/2001 | Hambleton | 297/4 |
| 6,213,314 | B1 | * | 4/2001 | Beemer | 211/70.6 |
| 6,893,097 | B1 | * | 5/2005 | Ebensperger et al. | 297/451.4 |
| 7,032,965 | B2 | * | 4/2006 | Howell et al. | 297/16.1 |
| 7,124,530 | B1 | * | 10/2006 | Clark | 42/94 |
| 8,465,090 | B1 | * | 6/2013 | O'Connor | 297/45 |
| 2004/0178666 | A1 | * | 9/2004 | Gray et al. | 297/16.1 |

FOREIGN PATENT DOCUMENTS

| | | | | |
|---|---|---|---|---|
| GB | 405969 | * | 2/1934 | A47C 9/10 |

OTHER PUBLICATIONS

TexasBowhunter.com, Marsh Seat—Stool Duck Season, Oct. 27, 2009, pp. 1-10.

* cited by examiner

*Primary Examiner* — David R Dunn
*Assistant Examiner* — Jody Giacoman
(74) *Attorney, Agent, or Firm* — Brooks Kushman P.C.

(57) ABSTRACT

A portable chair for outdoor activities that includes a blade that is inserted in the ground on one end of a main support and a seat on the other end of the main support. The blade and a mud stop bar resist displacement of the portable chair. A back rest support bar is attached to the seat and the main support. A back rest is attached to the back rest support bar. The back rest support bar may be completely disconnected or partially disconnected from the portable chair for transportation or storage.

13 Claims, 5 Drawing Sheets

PORTABLE CHAIR

CROSS-REFERENCE TO RELATED APPLICATIONS

This application claims the benefit of U.S. provisional application Ser. No. 61/684,295 filed Aug. 17, 2012, the disclosure of which is hereby incorporated in its entirety by reference herein.

TECHNICAL FIELD

This disclosure relates to a chair that is adapted for use in the field on the ground or in a marsh.

BACKGROUND

Hunters, fishermen and other persons who engage in outdoor activities may become tired of standing in a field or marsh. Chairs are not well suited for use on uneven ground surfaces or on ground that is covered or saturated with water. For example, a three legged stool or four legged chair may provide an uneven seating surface when placed on uneven ground. Likewise, when such conventional seating devices are attempted to be used in a marshy area the legs of the stool or chair tend to sink into the ground.

Some outdoor activities such as hunting or shore fishing may require traversing a long distance to a selected location and moving between different locations. Carrying a conventional chair or stool over long distances with other equipment is burdensome and may be difficult if it is necessary to walk through underbrush, a wooded area or a farm field to reach the selected location.

The disclosed apparatus is directed to solving the above problems and other problems as summarized below.

SUMMARY

According to several aspects of this disclosure, a portable hunting chair is disclosed that has a base on the lower end of a main support and a seat base attached to the upper end of the main support. The base may be a planar or a curved flat member or may be a U-shaped channel member. A mud stop may be provided on the main support above the base. The base resists pivoting fore-and-aft while the mud stop resists pivoting side-to-side. A foot rest may be provided on the main support between the mud stop and the seat base. A back support may be secured at an angle to the main support generally in the area of the foot rest. The back support may be disposed to extend outwardly and upwardly from the main support. The back support may also be attached to a support bar that extends from beneath the seat base to an intermediate point on the back support bar. A seat pad and a seat back pad may be provided on the seat and back support, respectively.

In one alternative embodiment, the back support bar may be attached to the main support by a hinge or other pivotable connector. In another alternative, the base may be removable from the main support.

According to one aspect of this disclosure, a portable chair is provided that includes a main support having an upper end and a lower end with a seat attached to the upper end of the main support. A blade is attached to the lower end of the main support and a mud stop bar is attached to a top edge of the blade at a location spaced above the lower end of the main support. A foot rest may be attached to the main support in a spaced relationship above the mud stop bar.

According to other aspects of this disclosure, the blade may be planar in shape or the blade may include a front wall and two rearwardly extending side walls. The planar blade and the front wall resist fore-and-aft displacement of the portable chair. The rearwardly extending side walls resist lateral displacement of the portable chair. The blade may be secured by fasteners to the main support. In addition, the blade may be welded to the mud stop bar.

According to another aspect of this disclosure, the portable chair may further comprise a back rest support bar having an upper end and a lower end with a back rest attached to the upper end of the back rest support bar. The lower end of the back rest support bar may be attached to the main support at an intermediate location adjacent to the foot rest.

According to another aspect of this disclosure, the portable chair may further comprise a first seat support bar extending perpendicularly from the top end of the main support in a rearward direction. A second seat support bar may extend from the main support bar to a point on the first seat support bar that is spaced from the main support and forming a triangle with the first seat support bar and the main support.

According to one additional aspect of this disclosure, the portable chair may further comprise an upper clevis bracket may be attached to the back rest support bar at a location adjacent to the seat. A first pin connecting the upper clevis bracket to at least one of the first seat support bar and the second seat support bar. A lower clevis bracket may be attached to the lower end of the back rest support bar. A second pin may connect the lower clevis bracket to the main support. The back rest support bar may be detached from the portable chair by removing the first and second pins.

Other features and aspects of the disclosure will be apparent in view of the attached drawings and the following detailed description of the illustrated embodiments.

DETAILED DESCRIPTION

A detailed description of the illustrated embodiments of the present invention is provided below. The disclosed embodiments are examples of the invention that may be embodied in various and alternative forms. The figures are not necessarily to scale. Some features may be exaggerated or minimized to show details of particular components. The specific structural and functional details disclosed in this application are not to be interpreted as limiting, but merely as a representative basis for teaching one skilled in the art how to practice the invention.

Figure 1:
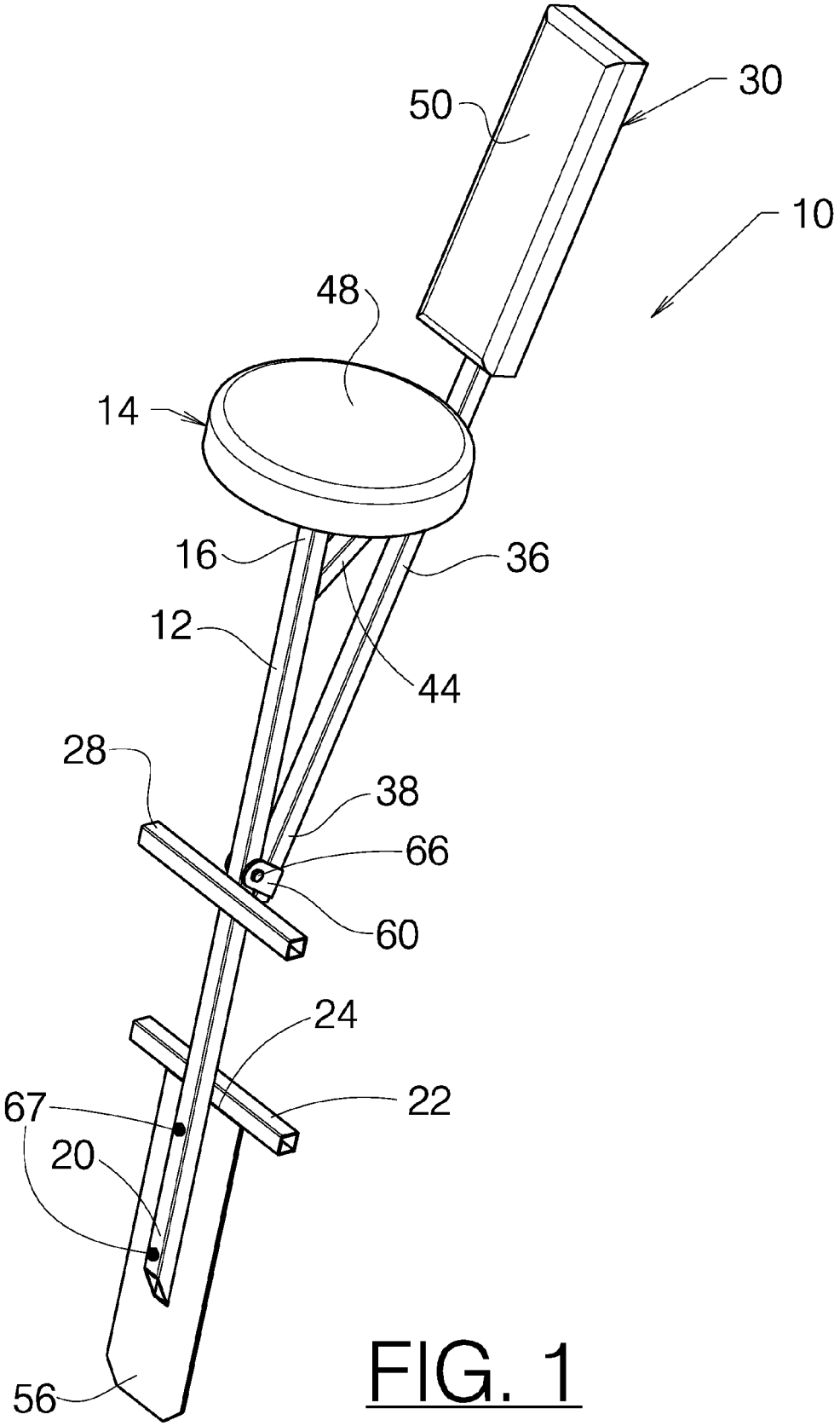
FIG. 1 is a perspective view of a portable chair made in accordance with one embodiment of the disclosure.
Figure 2:
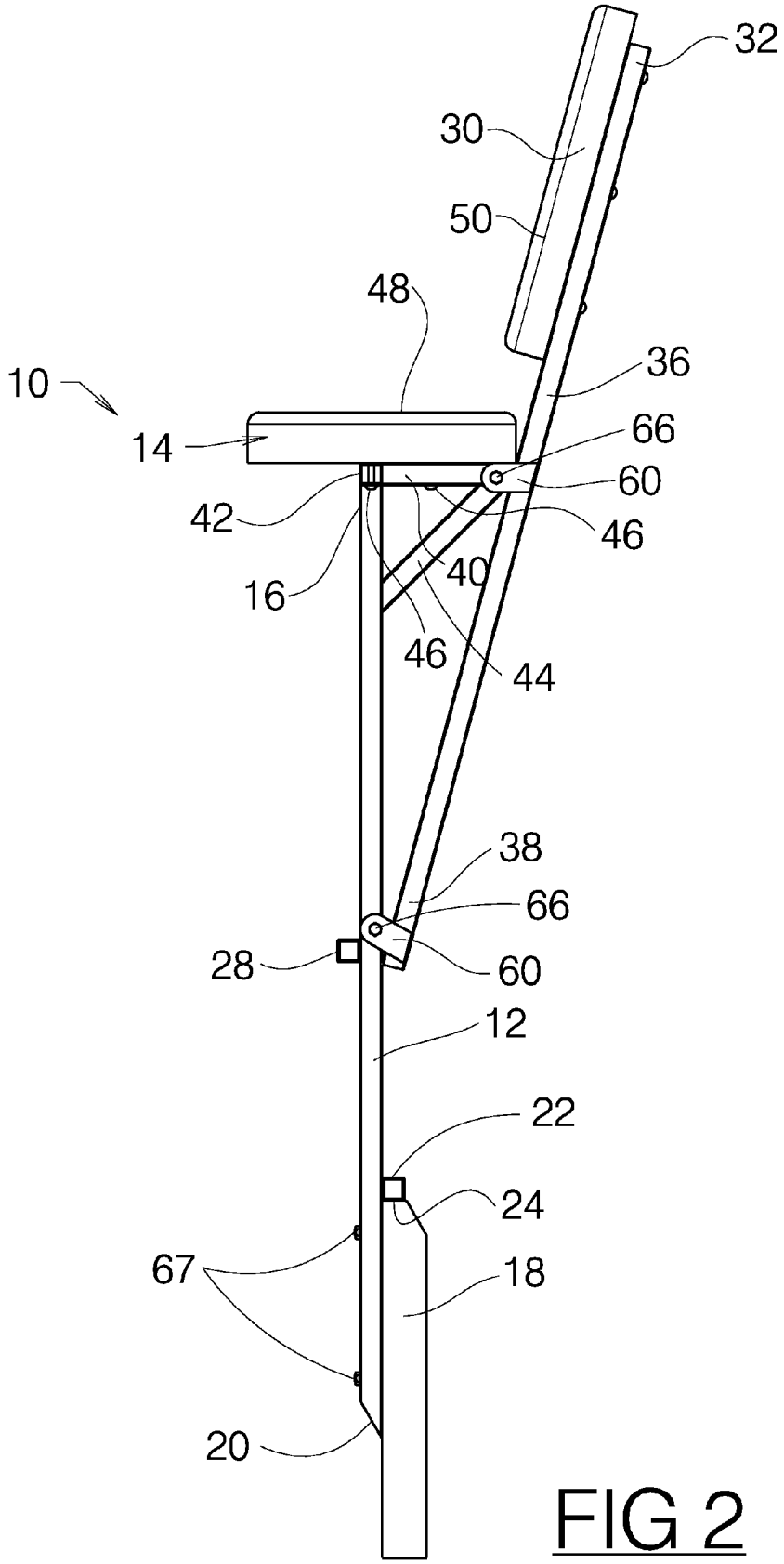
FIG. 2 is a side elevation view of the portable chair shown in FIG. 1.

Referring to FIGS. 1 and 2, a portable chair 10 is shown that is intended to be used by hunters, fisherman and other outdoor enthusiasts to provide comfortable seating on the ground or in marshes. The portable chair 10 includes a main support 12 that supports a seat 14 on an upper end 16 of the main support 12. A blade 18 is provided on a lower end 20 of the main support 12. A mud stop bar 22 is provided on a top edge 24 of the blade 18. A foot rest 28 is attached to the main support 12 between the mud stop bar 22 and the seat 14.

The portable chair 10 may also include a back rest 30 that is attached to an upper end 32 of a back rest support bar 36. A lower end 38 of the back rest support bar 36 is attached to the main support 12 near the foot rest 28, but on the opposite side of the main support 12 from the foot rest 28. A first seat support bar 40 extends between the main support 12 and the back rest support bar 36 and establishes the angle of the back rest 30 relative to the seat 14. A second seat support bar 42 extends laterally below seat 14 and is attached to the upper end 16 of the main support 12. The second seat support bar 42 supports the lateral sides of the seat 14. A seat reinforcement bar 44 connects the main support 12 to the back portion of the first seat support bar 42.

Figure 3:
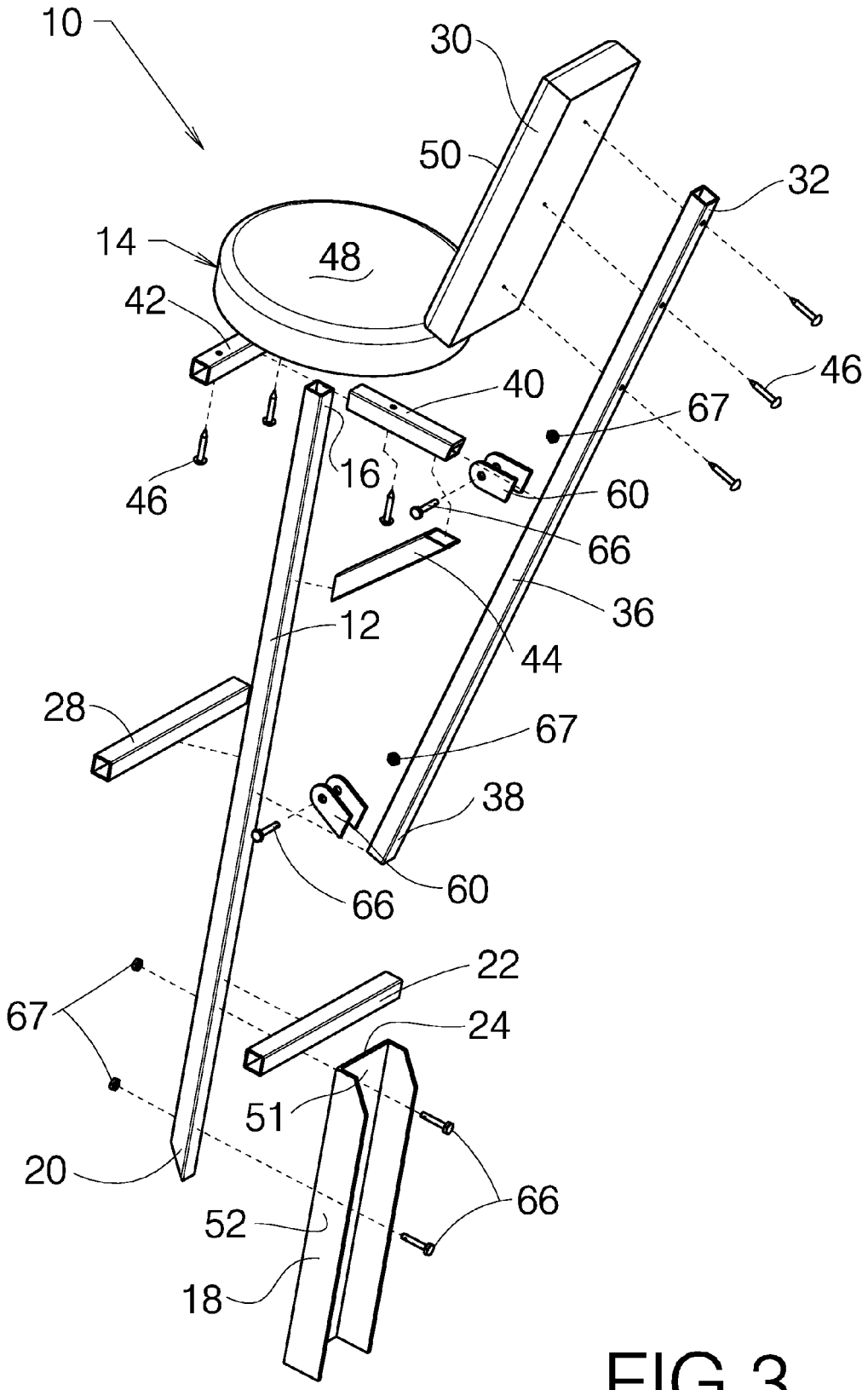
FIG. 3 is an exploded perspective view of the portable chair shown in FIG. 1.

Referring to FIGS. 1-3, the portable chair 10 is more fully described as to its structure and method of assembly. Fasteners 46, such as conventional bolts and screws, are used to secure the first and second seat support bars 40, 42 and the back rest support bar 36 to the back rest 30. In the illustrated embodiment, the back rest support bar 36 is fastened to the first seat support bar 40 and the lower end 38 of the back rest support bar is fastened to the main support 12. Alternatively, the bars could be welded to each other. The mud stop bar 22 and foot rest 28 are welded to the main support 12. Alternatively, the back rest support bar 36, mud stop bar 22 and foot rest 28 may be otherwise assembled by fasteners and/or brackets to the main support 12. The blade 18, as shown in FIG. 3, is secured by fasteners, such as a nut 67 and bolt 66, to the lower end 20 of the main support 12.

A clevis 60 may be provided on the back rest support bar 36, bottom end 38 and at an intermediate location to connect to the main support bar 12 and first seat support bar 40, respectively, with a nut 67 and bolt 66.

The seat 14 includes a seat pad 48. The back rest 30 includes a back rest pad 50. The seat bad 48 and back rest pad 50 are optional, but provide added comfort for the user.

The blade 18 includes a top edge 24 that is adjacent to or attached to the mud stop bar 22. The blade 18 includes a front wall 51 and two rearwardly extending side walls 52. The front wall 51 when placed in the ground or in a marshy area stabilizes the chair 10 in the fore-and-aft direction when it is inserted to the proper depth in the ground. The rearwardly extending side walls 52 stabilize the portable chair 10 and resist side-to-side displacement of the portable chair 10.

The blade 18 may be attached to the lower end 20 of the main support 12 by welding. Alternatively, the blade 18 may be attached by nuts 67 and bolts 66 or other fasteners. If the blade 18 is intended to be permanently attached, it may be welded to the main support bar 12. However, if the blade 18 is intended to be removable, it is fastened to the main support bar 12 by a plurality of fasteners 66, 67.

Figure 4:
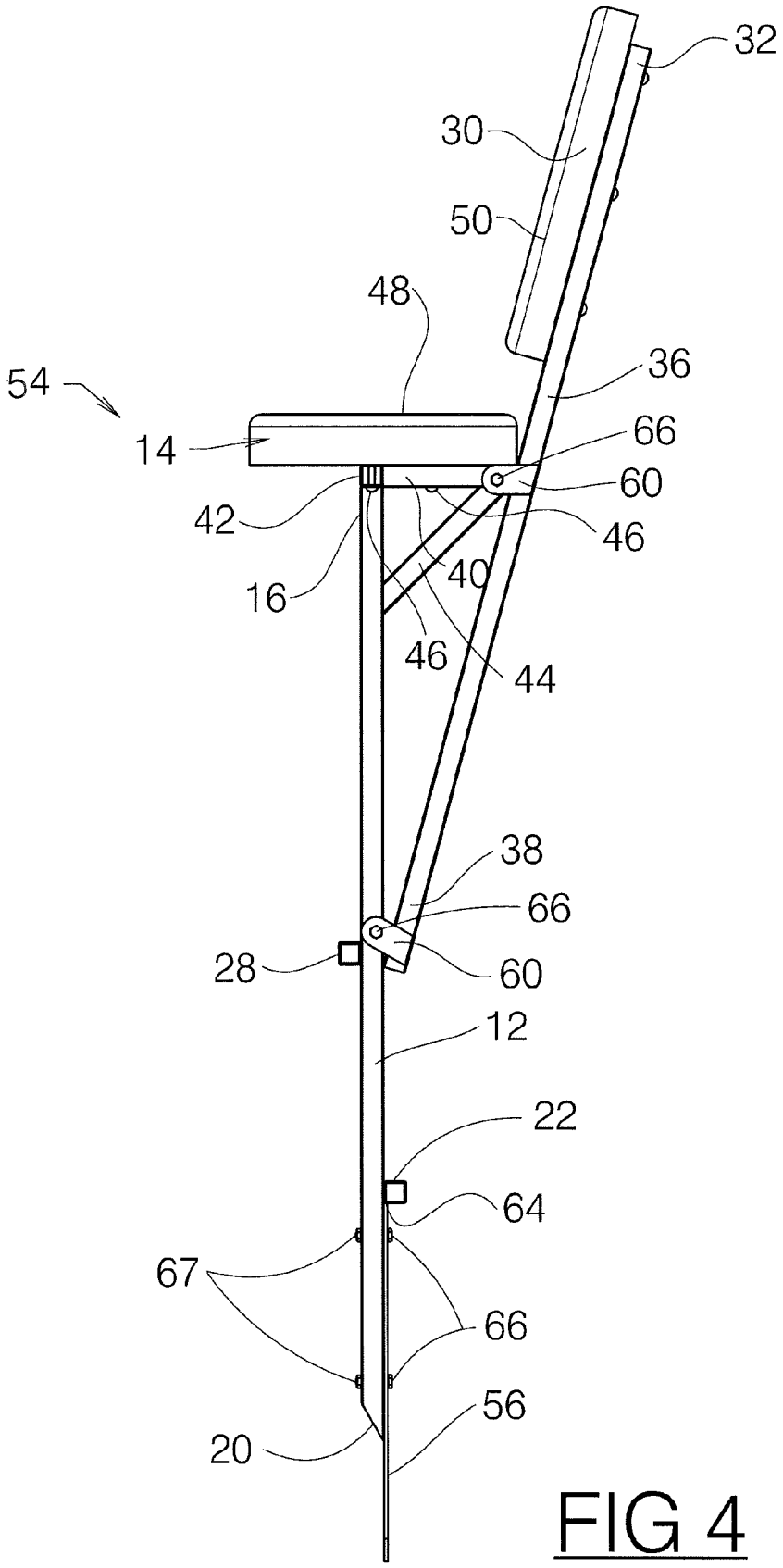
FIG. 4 is a side elevation view of the portable chair shown in FIG. 4.

Referring to FIG. 4, an alternative embodiment of a portable chair 54 is illustrated that includes additional features and structural elements. For brevity, components of the alternative chair 54 that are similar to components of the portable chair 10 are referred to by the same reference numerals as used in describing the embodiments of FIGS. 1-3.

One difference in the alternative portable chair 54 is that a single wall blade 56 is provided instead of the blade 18 of the embodiment of FIGS. 1-3. The single wall blade 56 is more compact and may be somewhat easier to insert into the ground. The mud stop bar 22 performs the function of preventing lateral side-to-side displacement of the chair 54.

A pair of hinge connectors 60, or clevis brackets, may be provided on the back rest support bar 36. One clevis bracket 60 may also be provided at an intermediate location on the back rest support 36 with a second clevis bracket 60 being provided on the lower end 38. A pair of bolts 66 may be inserted into the clevis bracket 60 to hold the back rest support bar 36 in engagement with the first seat support bar 40 and the main support 12. If the bolt 67 is removed from the clevis bracket 60 at the intermediate location, the back rest support bar 36 and back rest 30 may be pivoted away from the seat 14 and into a position parallel to the single wall blade 56. Alternatively, both of the bolts 67 may be removed from the two clevis brackets to fully disassemble the back rest support bar 36 from the chair 54 to provide a stool or for transportation and storage.

The top edge 64 of the single wall blade 56 is assembled to the mud stop bar 22 and the main support 12. Fasteners 66, 67 may be inserted through the single wall blade 56 and the main support 12 to retain the single wall blade 56 on the lower end 20 of the main support 12. Alternatively, the blade 56 may be welded to the lower end 20 of the main support 12 as previously described with reference to the blade 18 disclosed in FIGS. 1-3.

Figure 5:
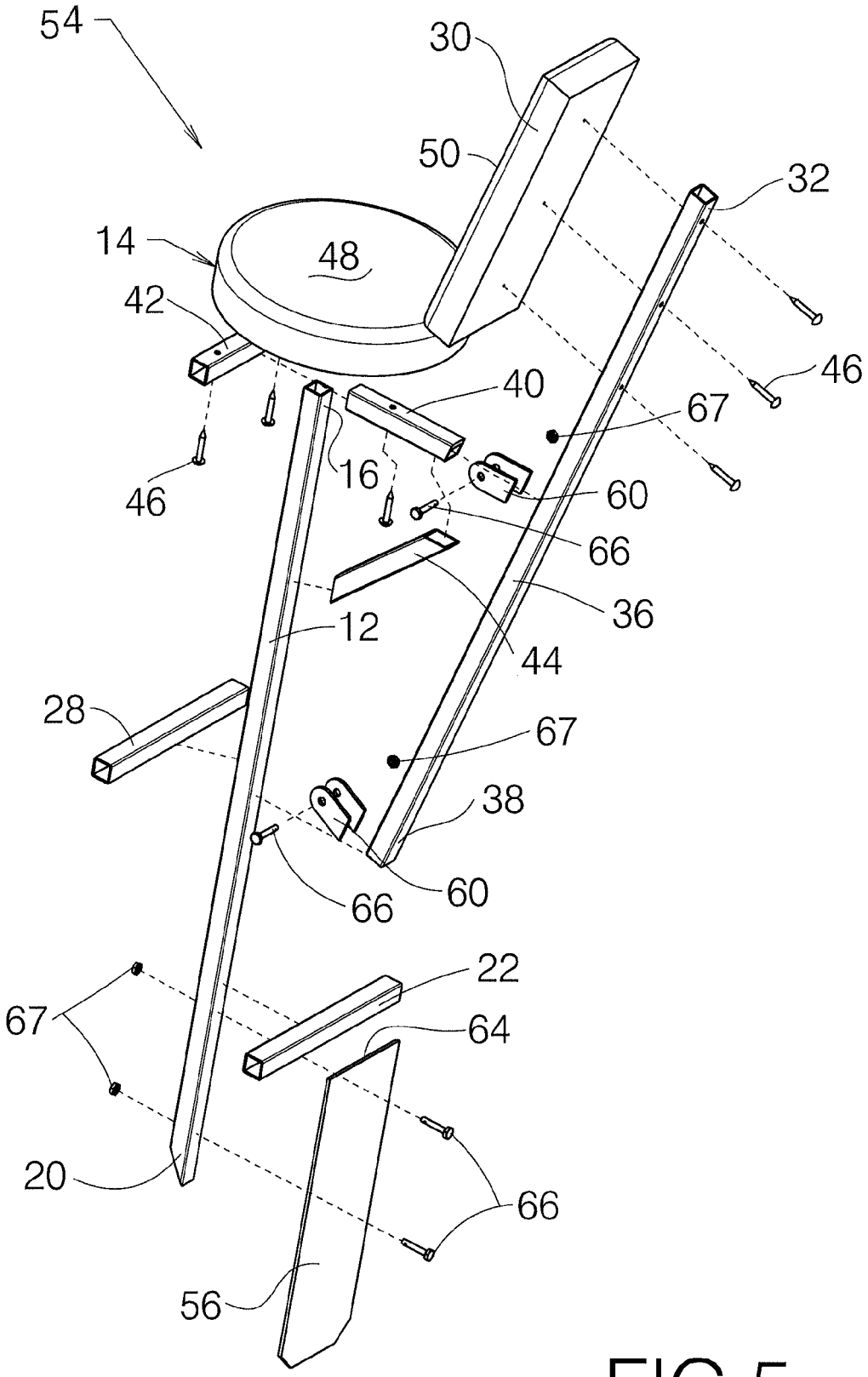
FIG. 5 is an exploded perspective view of the portable chair shown in FIG. 4.

Referring to the embodiment of FIGS. 4 and 5, the blade 56 is assembled to the lower end 20 of the main support 12 by fasteners 66, 67 that connect the blade 56 and main support 12. In this embodiment, the blade 56 may be disassembled from the main support 12 for transportation or storage.

The lower end 38 of the back rest support bar 36 is assembled to a clevis bracket 60 by the fasteners 66, 67 that also function as a hinge pin when the back rest support bar 36 is pivoted within the clevis bracket 60. The fasteners 66, 67 may also be completely removed to allow removal of the back rest 30 and the back rest support bar 36. The clevis bracket 60 on the back rest support bar 36 is attached to the first seat support bar 36 by fasteners 66, 67. If the fasteners 66, 67 in both clevis brackets 60 are removed, the back rest support bar 36 and back rest 30 may be completely removed from the main support 12 and seat 14 to make the portable chair 54 easier to transport and store.

While exemplary embodiments are described above, it is not intended that these embodiments describe all possible forms of the disclosed apparatus and method. Rather, the words used in the specification are words of description rather than limitation, and it is understood that various changes may be made without departing from the spirit and scope of the disclosure as claimed. The features of various implementing embodiments may be combined to form further embodiments of the disclosed concepts.

What is claimed is:

1. A portable chair comprising:

a main support having an upper end and a lower end;

a seat attached to the upper end of the main support;

a blade attached to the lower end of the main support;

a mud stop bar attached to a top edge of the blade at a location spaced above the lower end of the main support;

a foot rest attached to the main support in a spaced relationship above the mud stop bar;

a first seat support bar extending from a top end of the main support in a rearward direction; and a seat reinforcement bar extending from the main support to a point on the first seat support bar that is spaced from the main support and forming a triangle with the first seat support and the main support.

2. The portable chair of claim 1 wherein the blade is planar in shape and includes a single wall.

3. The portable chair of claim 2 wherein the blade is welded to the mud stop bar.

4. The portable chair of claim 2 wherein the blade is secured by fasteners to the main support.

5. The portable chair of claim 1 wherein the blade includes a front wall and two rearwardly extending side walls.

6. The portable chair of claim 5 wherein the blade is welded to the mud stop bar.

7. The portable chair of claim 5 wherein the blade is secured by fasteners to the main support.

8. A portable chair comprising:

a main support having an upper end and a lower end;

a seat attached to the upper end of the main support;

a blade attached to the lower end of the main support;

a mud stop bar attached to a top edge of the blade at a location spaced above the lower end of the main support;

a foot rest attached to the main support in a spaced relationship above the mud stop bar;

a back rest support bar having an upper end and a lower end;

a back rest attached to the upper end of the back rest support bar;

wherein the lower end of the back rest support bar is attached to the main support at an intermediate location adjacent to the foot rest;

a first seat support bar extending perpendicularly from a top end of the main support in a rearward direction; and a seat reinforcement bar extending from the main support to a point on the first seat support bar that is spaced from the main support and forming a triangle with the first seat support bar and the main support.

9. The portable chair of claim 8 further comprising;

an upper clevis bracket attached to the back rest support bar adjacent to the seat;

a first pin connecting the upper clevis bracket to at least one of the first seat support bar and the seat reinforcement bar;

a lower clevis bracket attached to the lower end of the back rest support bar; and a second pin connecting the lower clevis bracket to the main support, wherein the back rest support bar may be detached from the portable chair by removing the first and second pins.

10. A portable chair comprising:

a main support having an upper end and a lower end;

a seat attached to the upper end of the main support;

a blade attached to the lower end of the main support, wherein the blade is inserted into a ground area to stabilize the portable chair in a fore-and-aft direction;

a mud stop bar attached to a top edge of the blade at a location spaced above the lower end of the main support, wherein the mud stop bar engages the ground area to stabilize the portable chair in a lateral direction;

a back rest support bar having an upper end and a lower end;

a back rest attached to the upper end of the back rest support bar; and wherein the lower end of the back rest support bar is attached to the main support at an intermediate location;

a first seat support bar extending perpendicularly from a top end of the main support in a rearward direction;

a seat reinforcement bar extending from the main support to a point on the first seat support bar that is spaced from the main support, wherein the first seat support and the main support form a triangle with the second seat support;

an upper bracket attached to the back rest support bar adjacent to the seat;

a first pin connecting the upper bracket to at least one of the first seat support bar and the seat reinforcement bar;

a lower bracket attached to the lower end of the back rest support bar; and a second pin connecting the lower bracket to the main support, wherein the back rest support bar may be detached from the portable chair by removing the first and second pins.

11. The portable chair of claim 10 wherein the blade is planar in shape and includes a single wall.

12. The portable chair of claim 10 wherein the blade includes a front wall and two rearwardly extending side walls.

13. The portable chair of claim 10 further comprising;

a foot rest attached to the main support in a spaced relationship above the mud stop bar.

* * * * *